US011197601B2

(12) United States Patent
Durham et al.

(10) Patent No.: US 11,197,601 B2
(45) Date of Patent: Dec. 14, 2021

(54) DISHWASHER APPLIANCE EQUIPPED WITH LEAK DETECTION FEATURES

(71) Applicant: Haier US Appliance Solutions, Inc., Wilmington, DE (US)

(72) Inventors: Kyle Edward Durham, Louisville, KY (US); Craig Curtis, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 312 days.

(21) Appl. No.: 16/401,270

(22) Filed: May 2, 2019

(65) Prior Publication Data

US 2020/0345201 A1 Nov. 5, 2020

(51) Int. Cl.
*A47L 15/00* (2006.01)
*A47L 15/42* (2006.01)

(52) U.S. Cl.
CPC ..... *A47L 15/4212* (2013.01); *A47L 15/0049* (2013.01); *A47L 2401/09* (2013.01); *A47L 2401/20* (2013.01); *A47L 2401/34* (2013.01); *A47L 2501/03* (2013.01); *A47L 2501/26* (2013.01); *A47L 2501/36* (2013.01)

(58) Field of Classification Search
None
See application file for complete search history.

(56) References Cited

U.S. PATENT DOCUMENTS

| | | | |
|---|---|---|---|
| 9,565,987 | B2 | 2/2017 | Poyner et al. |
| 2009/0000671 | A1 | 1/2009 | Montagnana |
| 2013/0008477 | A1 | 1/2013 | Forst et al. |
| 2018/0132694 | A1 | 5/2018 | Thiyagarajan et al. |

FOREIGN PATENT DOCUMENTS

| | | | |
|---|---|---|---|
| EP | 2044876 | B1 | 12/2015 |
| KR | 101307590 | B1 | 9/2013 |

*Primary Examiner* — Levon J Shahinian
(74) *Attorney, Agent, or Firm* — Dority & Manning, P.A.

(57) ABSTRACT

A dishwasher appliance equipped with leak detection features and a method of detecting leak conditions during an operation cycle of a dishwasher are provided. In one aspect, the dishwasher appliance includes a tub having a sump. A pressure sensor is mounted to the sump and is configured to monitor the sump pressure during an operation cycle. If the sump pressure falls below a pressure threshold during a circulation cycle, corrective action can be taken. For instance, a circulation pump circulating wash fluid through the tub can deactivated and a static pressure reading can be taken by the pressure sensor. The static pressure reading can be compared to a static pressure reading taken prior to the circulation cycle. In response to whether the static pressure is within a predetermined range of the static pressure reading taken prior to the circulation cycle, the circulation cycle can be recommenced or aborted.

12 Claims, 5 Drawing Sheets

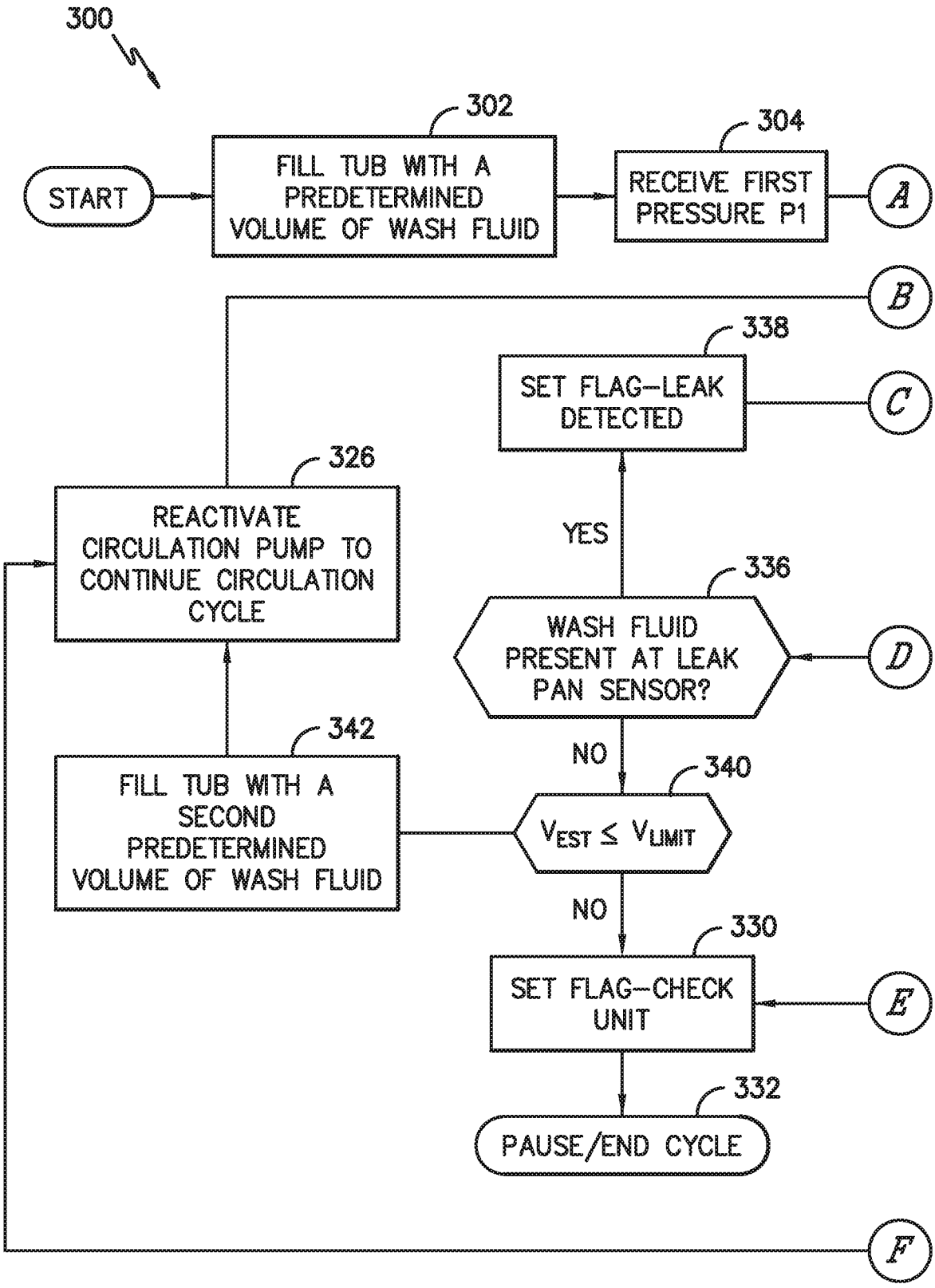
FIG. –3A–

DISHWASHER APPLIANCE EQUIPPED WITH LEAK DETECTION FEATURES

FIELD OF THE INVENTION

The present disclosure relates generally to dishwasher appliances, and more particularly to dishwasher appliances having leak detection features.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles disposed within the rack assemblies in order to clean such articles. Dishwasher appliances are also typically equipped with a circulation pump for circulating fluid through the multiple spray assemblies. Tubs also include a sump that collects wash fluid after being dispensed from the spray assemblies.

Under certain conditions, dishwasher appliances are prone to leaks. For instance, degradation of sealing components and/or improper assembly can cause dishwasher appliances to leak. When leaks occur, water can spill out onto a consumer's floor, among other potential issues. While some conventional dishwasher appliances include sensors for detecting leaks, feedback from such sensors is not used in a proactive manner to stop leak events during an operation cycle. Moreover, there are no known dishwashers that attempt to recover a cycle based on such sensor feedback.

Accordingly, a dishwasher appliance and method therefore that address one or more of the challenges noted above would be useful.

BRIEF DESCRIPTION OF THE INVENTION

Aspects and advantages of the invention will be set forth in part in the following description, may be apparent from the description, or may be learned through practice of the invention.

In one aspect, a method of detecting a leak condition for a dishwasher appliance is provided. The method includes filling a wash fluid into a tub of the dishwasher appliance. The method also includes receiving data indicative of a first pressure of the wash fluid disposed within the tub. Further, the method includes activating, after receiving the data indicative of the first pressure of the wash fluid disposed within the tub, a circulation pump to circulate the wash fluid. The method also includes iteratively receiving data indicative of a second pressure of the wash fluid disposed within the tub. Further, the method includes determining whether the second pressure is less than a pressure threshold. The method also includes deactivating the circulation pump if the second pressure is less than the pressure threshold. Moreover, the method includes receiving, after a predetermined time of deactivating the circulation pump, data indicative of a third pressure of the wash fluid disposed within the tub. The method also includes determining whether the third pressure is within a predetermined range of the first pressure. Further, the method includes generating, in response to whether the third pressure is within the predetermined range of the first pressure, a control action.

In another aspect, a dishwasher appliance is provided. The dishwasher appliance includes a cabinet and a tub positioned within the cabinet and having a sump, the tub defining a wash chamber for receipt of articles for washing. Further, the dishwasher appliance includes a pressure sensor positioned in the sump of the tub. The dishwasher appliance also includes a water inlet valve for selectively allowing a wash fluid into the tub and a circulation pump for circulating the wash fluid disposed within the tub. The dishwasher appliance further includes a controller communicatively coupled with the pressure sensor, the water inlet valve, and the circulation pump. The controller is configured to: cause the water inlet valve to selectively allow a predetermined volume of the wash fluid to flow into the tub; receive, from the pressure sensor, data indicative of a first pressure of the predetermined volume of the wash fluid disposed within the tub; activate, after receiving the data indicative of the first pressure of the wash fluid disposed within the tub, the circulation pump to circulate the wash fluid; iteratively receive, from the pressure sensor, data indicative of a second pressure of the wash fluid disposed within the tub; determine whether the second pressure is below a pressure threshold; deactivate the circulation pump if the second pressure is below the pressure threshold; receive, from the pressure sensor after a predetermined time of deactivating the circulation pump, data indicative of a third pressure of the wash fluid disposed within the tub; determine whether the third pressure is within a predetermined range of the first pressure; and generate, in response to whether the third pressure is within the predetermined range of the first pressure, a control action.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIGS. 3A and 3B provide a flow diagram for a method of detecting a leak condition of a dishwasher appliance during an operation cycle according to an example embodiment of the present disclosure.

DETAILED DESCRIPTION OF THE INVENTION

Figure 1:
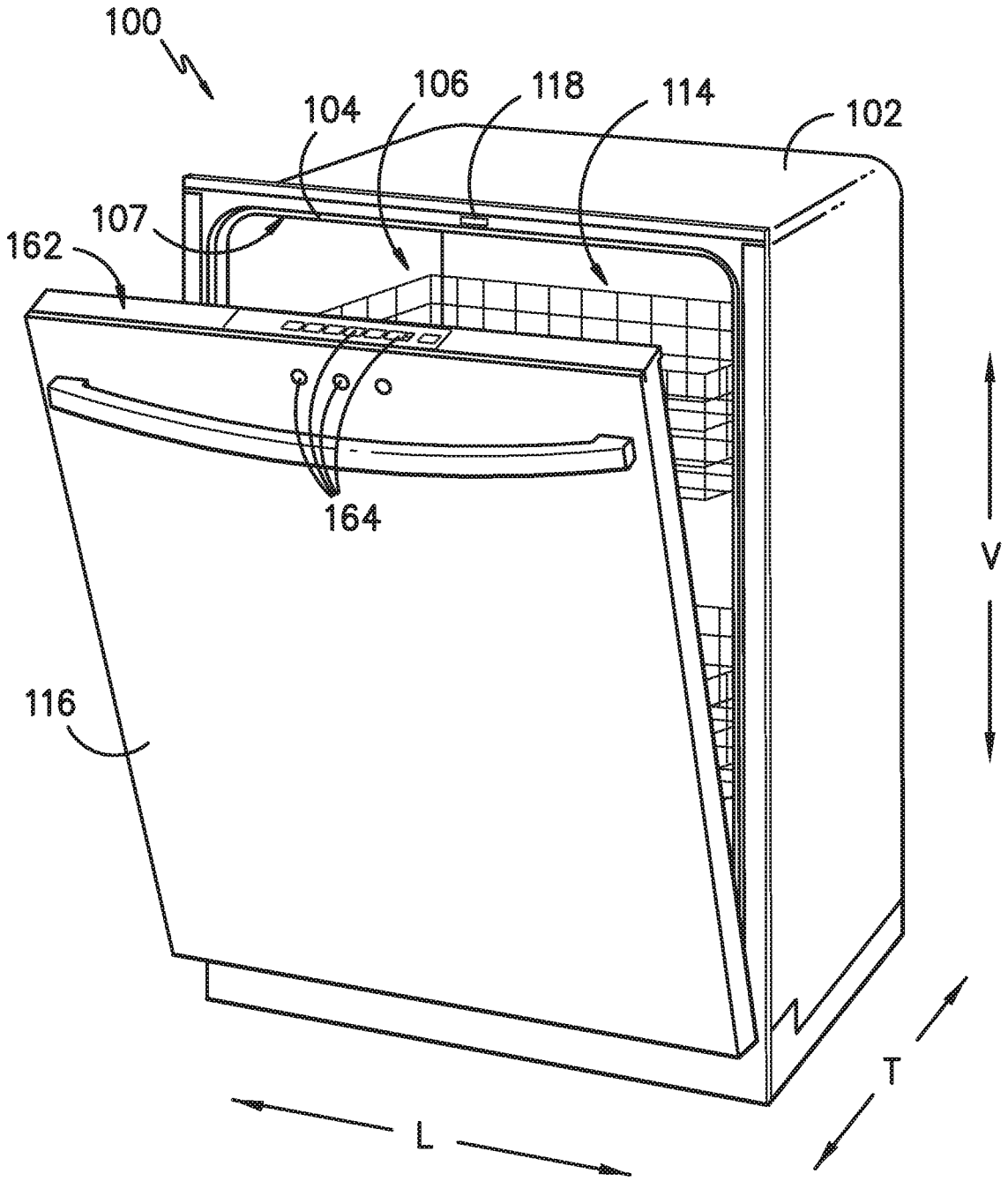
FIG. 1 provides a perspective view of a dishwasher appliance according to an example embodiment of the present disclosure with a door of the dishwasher depicted in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a fifteen percent (15%) margin of error.

Figure 2:
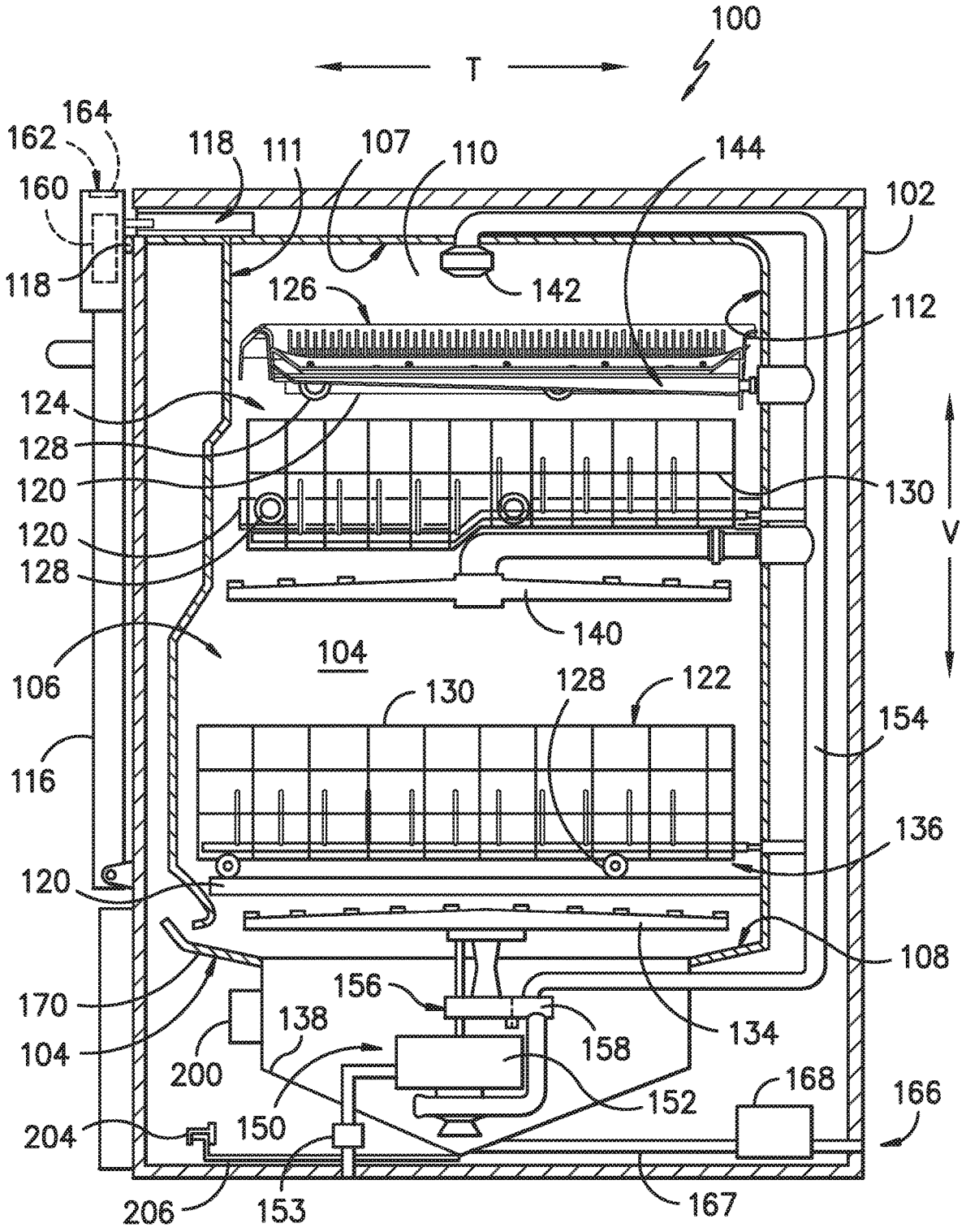
FIG. 2 provides a side, cross sectional view of the dishwasher appliance of FIG. 1.

FIGS. 1 and 2 depict a dishwasher or dishwashing appliance 100 according to an example embodiment of the present disclosure. For the particular embodiment of FIGS. 1 and 2, dishwasher 100 defines a vertical direction V, a lateral direction L, and a transverse direction T. Each of the vertical direction V, lateral direction L, and transverse direction T are mutually perpendicular to one another and form an orthogonal direction system. Dishwasher 100 includes a cabinet 102 having a tub 104 positioned therein. Tub 104 defines a wash chamber 106 configured for receipt of articles for washing, such as e.g., pots, pans, dishes, silverware, etc. As shown in FIG. 2, tub 104 extends between a top 107 and a bottom 108 along the vertical direction V, between a pair of sidewalls 110 along the lateral direction L, and between a front side 111 and a rear side 112 along the transverse direction T.

Tub 104 includes a front opening 114 (FIG. 1) and a door 116 hinged at its bottom for movement between a normally closed vertical position (shown in FIG. 2), wherein the wash chamber 106 is sealed shut for washing operation and a horizontal open position for loading and unloading of articles from the dishwasher 100. Dishwasher 100 includes a door closure mechanism or assembly 118 that is used to lock and unlock door 116 for accessing and sealing wash chamber 106.

As further shown in FIG. 2, tub sidewalls 110 accommodate a plurality of rack assemblies. More specifically, guide rails 120 are mounted to sidewalls 110 for supporting a lower rack assembly 122, a middle rack assembly 124, and an upper rack assembly 126. Upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to other exemplary embodiments, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 is generally configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating wash fluid in tub 104. More specifically, fluid circulation assembly 150 includes a circulation pump 152 for circulating water and wash fluid (e.g., detergent, water, and/or rinse aid) in tub 104. Circulation pump 152 is located within sump 138 in this example embodiment. In other embodiments, circulation pump 152 can be located in other locations, such as e.g., within a machinery compartment located below sump 138 of tub 104. Circulation pump 152 is in fluid communication with an external water supply line (not shown) and sump 138. A water inlet valve 153 can be positioned between the external water supply line and circulation pump 152 to selectively allow water to flow from the external water supply line to circulation pump 152. Additionally or alternatively, water inlet valve 153 can be positioned between the external water supply line and sump 138 to selectively allow water to flow from the external water supply line to sump 138. Water inlet valve 153 can be selectively controlled to open to allow the flow of water or wash fluid into dishwasher 100 and can be selectively controlled to cease the flow of water into dishwasher 100. Further, fluid circulation assembly 150 may include one or more fluid conduits or circulation piping for directing water and/or wash fluid from circulation pump 152 to the various spray assemblies and manifolds. For example, for the embodiment depicted in FIG. 2, a primary supply conduit 154 extends from circulation pump 152, along rear 112 of tub 104 along the vertical direction V to supply wash fluid throughout wash chamber 106.

As further illustrated in FIG. 2, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc.

In operation, circulation pump 152 draws wash fluid in from sump 138 and pumps it to a diverter 156, e.g., which is positioned within sump 138 of dishwasher appliance. Diverter 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

Diverter 156 is configured for selectively distributing the flow of wash fluid from circulation pump 152 to various fluid supply conduits, only some of which are illustrated in FIG. 2 for clarity. More specifically, diverter 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level and/or upper spray assemblies 140, 142, e.g., such as primary supply conduit 154.

Drainage of soiled water within sump 138 may occur, for example, through drain assembly 166. In particular, water may exit sump 138 through a drain and may flow through a drain conduit 167. A drain pump 168 may facilitate drainage of the soiled water by pumping the water to a drain line external to the dishwasher 100.

Dishwasher 100 is equipped with a controller 160 to regulate operation of dishwasher 100. Controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 160 may be positioned in a variety of locations throughout dishwasher 100. For instance, as shown in FIG. 2, controller 160 is located within a control panel area 162 of door 116. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In one embodiment, the user interface 164 may represent a general purpose I/O ("GPIO") device or functional block. In one embodiment, the user interface 164 may include input components, such as one or more of a variety of electrical, mechanical or electromechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

With reference still to FIG. 2, in some instances, dishwasher 100 may experience a leak event or condition. In such instances, wash fluid may leak from tub 104, sump 138, or another component of dishwasher 100. To detect such leak events or conditions, dishwasher 100 includes various sensors that provide feedback to controller 160 such that corrective action may be taken. For instance, as shown in the depicted embodiment of FIG. 2, dishwasher 100 includes a pressure sensor 200 positioned on or mounted to sump 138. Pressure sensor 200 is configured to monitor the pressure of the wash fluid within sump 138 of tub 104. Pressure sensor 200 is communicatively coupled with controller 160. Pressure sensor 200 can send signals to controller 160 indicative of the pressure of the wash fluid in tub 104, or more particularly, sump 138. Pressure sensor 200 can be any suitable type of sensor capable of sensing the pressure of the wash fluid within sump 138 of tub 104.

In some embodiments, dishwasher 100 includes a leak pan 206 positioned below sump 138 and tub 104 along the vertical direction V. Leak pan 206 is configured to collect leaking wash fluid. In addition, as shown in FIG. 2, dishwasher 100 includes a leak pan sensor 204 positioned on or mounted to leak pan 206. Leak pan sensor 204 is configured to detect wash fluid in leak pan 206. Particularly, for this embodiment, leak pan sensor 204 is configured to sense wash fluid that is a predetermined distance from a pan lip of leak pan 206. Leak pan sensor 204 is communicatively coupled with controller 160 and may communicate with controller 160 via one or more signals. Leak pan sensor 204 can be a conductivity sensor, for example. Accordingly, in accordance with aspects of the present disclosure, dishwasher 100 may utilize feedback from pressure sensor 200 and/or leak pan sensor 204 to detect and/or prevent leak events.

Figure 3B:
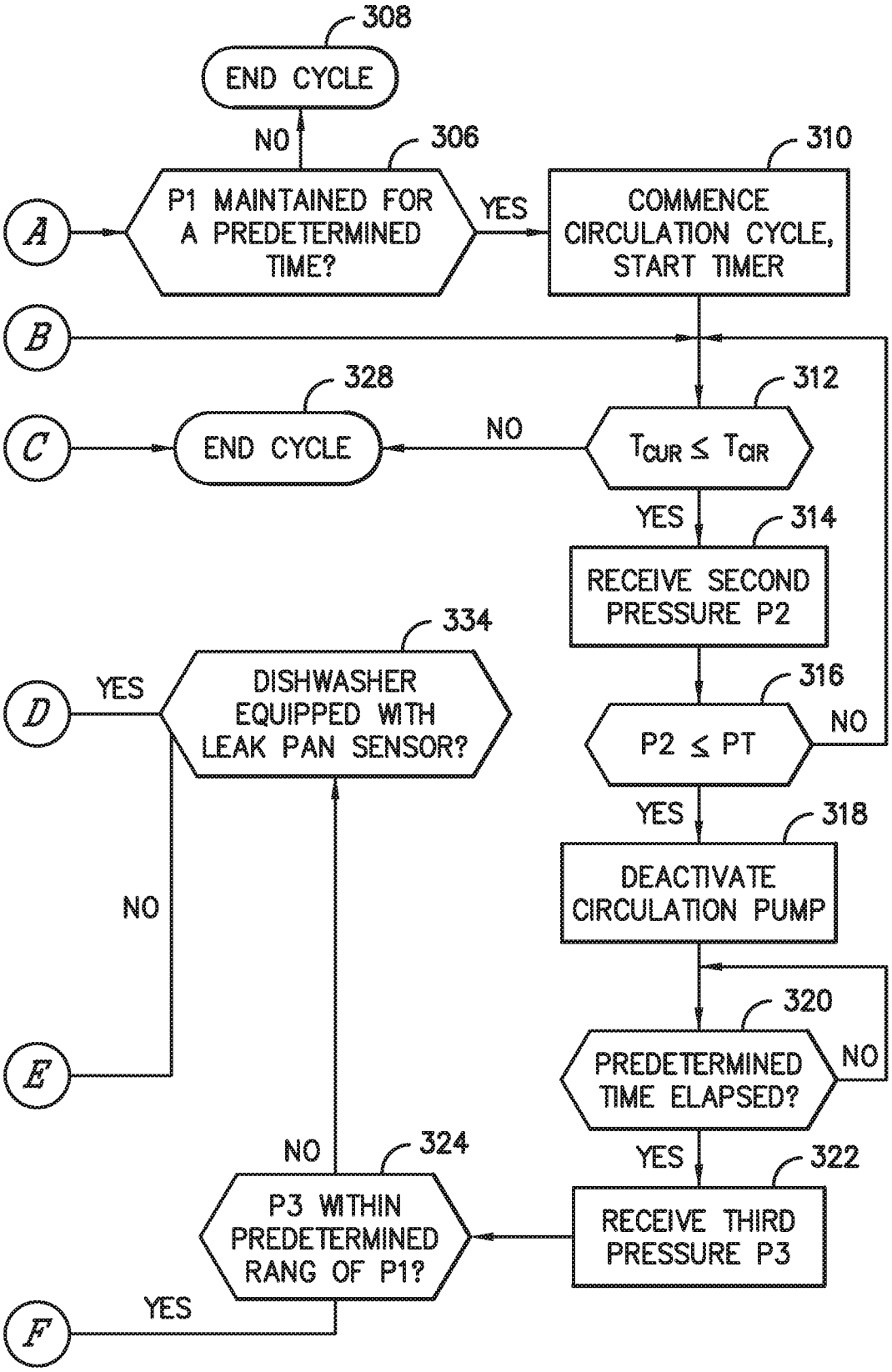
Figure 4:
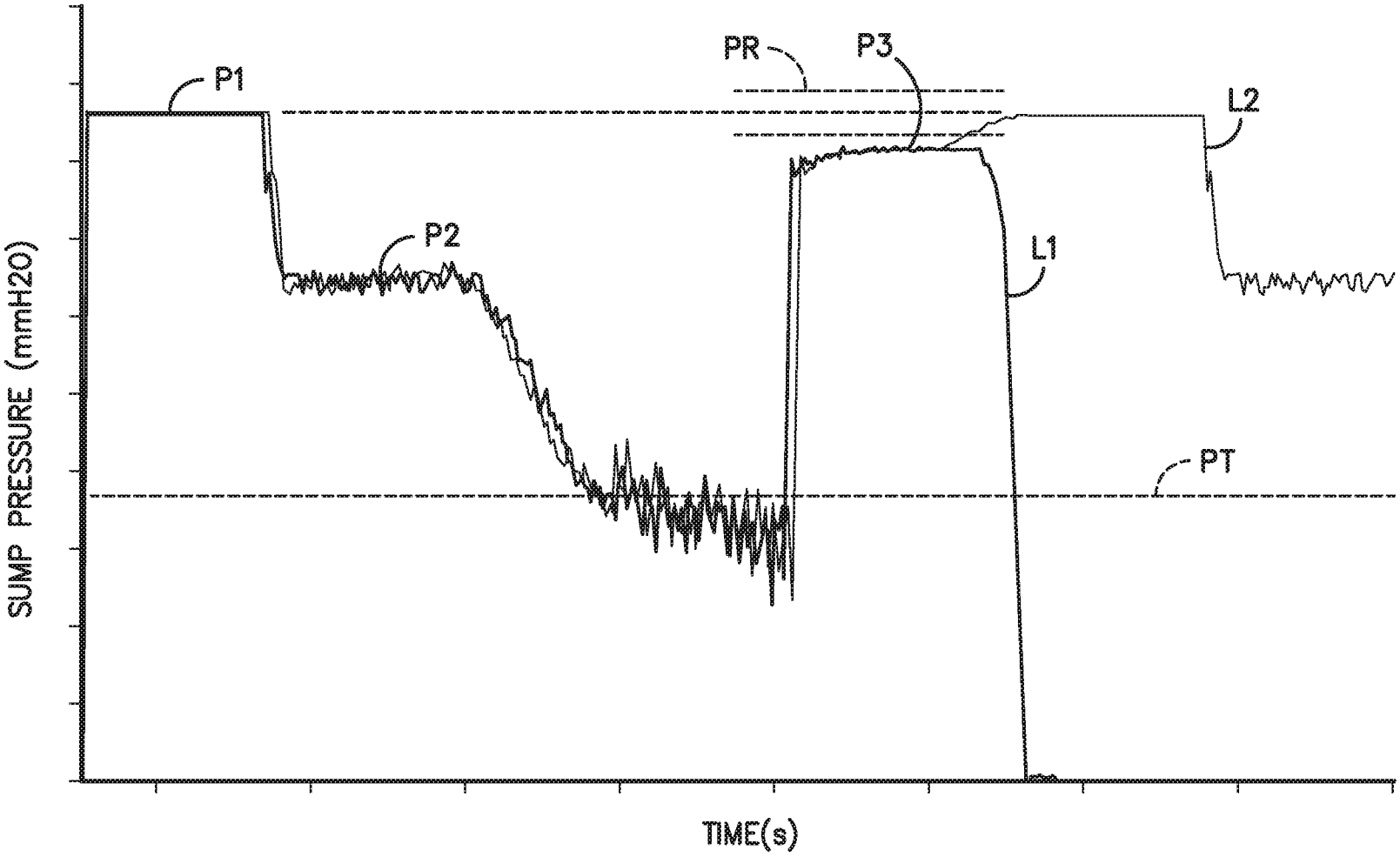
FIG. 4 provides a graph depicting sump pressure as a function of time during an operation cycle according to an example embodiment of the present disclosure.

Referring now to FIGS. 3A, 3B and 4, FIGS. 3A and 3B provide a flow diagram for a method (300) of detecting a leak condition for a dishwasher appliance according to an example embodiment of the present disclosure. For instance, the method (300) can be used for leak detection of the dishwasher appliance 100 of FIGS. 1 and 2. Further, as will be explained below, outputs of the pressure sensor 200 and leak pan sensor 204 can be utilized to detect leak events or conditions of dishwasher 100. To provide context to exemplary method (300), the reference numerals used in FIGS. 1 and 2 to describe the features of dishwasher 100 will be used below. It will be appreciated, however, that method (300) is not limited in scope to dishwasher 100 of FIGS. 1 and 2; rather, method (300) is applicable to other suitable configurations of dishwashers. FIG. 4 provides a graph depicting sump pressure as a function of time during an operation cycle according to an example embodiment of the present disclosure.

At (302), the method (300) includes filling a wash fluid into a tub of the dishwasher appliance. For instance, with reference to FIG. 2, with dishwasher 100 powered up, dishwasher 100 can be operated in a fill cycle. The fill cycle is one cycle or sub cycle of an operation cycle, which generally includes a fill cycle, a circulation cycle for washing articles within wash chamber 106 of dishwasher 100, and a drying cycle. In performing the fill cycle, the controller 160 can cause water inlet valve 153 to selectively allow a predetermined volume of the wash fluid to flow into the tub 104. Wash fluid flowing into tub 104 can flow directly into sump 138 of tub 104 and/or into circulation pump 152. Controller 160 can determine the predetermined volume of water flowing into tub 104 in any suitable manner. For instance, the controller 160 can calculate or estimate the volume of wash fluid in tub 104 by tracking the valve open time of water inlet valve 153 and by knowing or calculating the flow rate through water inlet valve 153. In this way, the predetermined volume of wash fluid within tub 104 can be estimated. Furthermore, after filling the tub 104 with the predetermined volume of wash fluid, the controller 160 can cause water inlet valve 153 to prevent or prohibit additional wash fluid from flowing into tub 104. Moreover, as shown in FIG. 4, the sump pressure increases during filling at (302).

At (304), as depicted in FIGS. 3A and 3B, the method (300) includes receiving data indicative of a first pressure of the wash fluid disposed within the tub. For instance, with reference to FIG. 2, the controller 160 can receive, from pressure sensor 200, data indicative of a first pressure P1 of the predetermined volume of the wash fluid disposed within tub 104. Particularly, the controller 160 can receive one or more signals from pressure sensor 200 indicative of the pressure of the wash fluid within sump 138 of tub 104 after the predetermined volume of the wash fluid is filled into tub 104 of the dishwasher appliance 100. In this manner, the first pressure P1 is indicative of the pressure of the wash fluid in sump 138 of tub 104 prior to a circulation cycle. As shown in FIG. 4, once the predetermined volume of wash fluid is filled into tub 104, the static sump pressure has a pressure P1.

At (306), in some implementations, after receiving the data indicative of the first pressure of the wash fluid disposed within the tub, the method (300) includes determining whether the first pressure of the predetermined volume of wash fluid is maintained within a predetermined range for a predetermined time. For instance, the controller 160 can record the first pressure P1 (e.g., the first pressure P1 can be stored in a memory device of controller 160) and receive further data or signals indicative of the pressure of the wash fluid within sump 138 of tub 104 prior to commencing a circulation cycle. The sensed pressure readings can be compared with the first pressure P1 by controller 160 to determine whether the first pressure P1 is maintained within a predetermined range (e.g., within plus or minus five percent (5%) of the first pressure P1) for a predetermined time (e.g., three seconds (3 s)). If the first pressure P1 of the predetermined volume of the wash fluid is maintained within the predetermined range for the predetermined time, the circulation pump 153 is activated to circulate the wash fluid, e.g. at (310) as described below. On the other hand, if the first pressure P1 of the predetermined volume of the wash fluid is not maintained within the predetermined range for the predetermined time, the circulation pump 153 is not activated, e.g., at (306), and the cycle ends at (308) as a leak condition is present. In this way, controller 160 can first check for leak conditions prior to commencing a circulation cycle.

At (308), the method (300) includes ending or terminating the cycle if the first pressure P1 of the predetermined volume of the wash fluid is not maintained within the predetermined range for the predetermined time. Accordingly, the circulation cycle is not commenced at (310) as described below. In addition, to terminating the operation cycle, the controller 160 can activate drain pump 168 to drain any remaining wash fluid in sump 138 of tub 104.

At (310), the method (300) includes activating, after receiving the data indicative of the first pressure of the wash fluid disposed within the tub, a circulation pump to circulate the wash fluid. That is, once the fill cycle is complete and the first pressure P1 is received and recorded, the circulation cycle commences. For instance, to activate the circulation cycle, the controller 160 can activate, after receiving the data indicative of the first pressure P1 of the wash fluid disposed within tub 104, the circulation pump 153 to circulate the wash fluid. Upon activation of the circulation pump 153, circulation pump 153 draws wash fluid disposed within sump 138 therein and circulates the wash fluid throughout tub 104. For instance, circulation pump 153 can move wash fluid to diverter 156 where the wash fluid can be directed to the various spray assemblies 134, 140, 142. The wash fluid is then dispensed from the spray assemblies 134, 140, 142 onto articles within wash chamber 106. Some of the wash fluid then returns to sump 138 where it can be recirculated by circulation pump 153 during the circulation cycle. In addition, at (310), the method (300) includes commencing a timer. The timer can track or be indicative of the current time of the circulation cycle, denoted as $T_{CUR}$ in FIG. 3B, or the time in which circulation pump 153 is activated.

As shown in FIG. 4, once the predetermined volume of wash fluid is filled into tub 104 and the first pressure P1 of the predetermined volume of the wash fluid is maintained within the predetermined range for the predetermined time, the circulation pump 153 is activated, which causes the sump pressure to decrease. The sump pressure eventually settles during the circulation cycle.

At (312), the method (300) includes determining whether a predetermined circulation time has elapsed. For instance, as shown in FIG. 3B, if the current time of the circulation cycle $T_{CUR}$ is less than or equal to the predetermined circulation time $T_{CIR}$, then the controller 160 determines that the predetermined circulation time has not elapsed and the method (300) proceeds to (314). On the other hand, if the current time of the circulation cycle $T_{CUR}$ is not less than or equal to the predetermined circulation time $T_{CIR}$ (that is, if the current time of the circulation cycle $T_{CUR}$ is greater than the predetermined circulation time $T_{CIR}$), then the controller 160 determines that the predetermined circulation time has elapsed and the method (300) proceeds to (328).

At (314), the method (300) includes iteratively receiving data indicative of a second pressure of the wash fluid disposed within the tub. Stated another way, during the circulation cycle, the pressure of the wash fluid disposed within the tub is monitored. For instance, the controller 160 can iteratively receive, from the pressure sensor 200, data indicative of a second pressure P2 of the wash fluid disposed within the tub 104, or more particularly, sump 138 of tub 104. During a normal circulation cycle, the second pressure P2 is expected to be less than the static first pressure P1 as some of the wash fluid is not present in sump 138 during the circulation cycle (e.g., some of the wash fluid can be disposed within primary supply conduit 154, within the spray assemblies 134, 140, 142, trapped within pots, glasses, etc., or some combination thereof.

At (316), the method (300) includes determining whether the second pressure is below or equal to a pressure threshold. For instance, the controller 160 can determine whether the received second pressure P2 is below or equal to a pressure threshold PT. As shown in FIG. 4, for example, during the circulation cycle, sump pressure readings P2 are sensed by pressure sensor 200 and received by controller 160. Controller 160 monitors whether one of the sump pressure readings, or second pressure P2, falls below or is equal to the pressure threshold PT.

In some implementations, the pressure threshold PT can be set as a fixed value. For instance, the pressure threshold PT can be set as a predetermined pressure value. In yet other implementations, the pressure threshold PT can be set as a variable value that can be set in accordance with the initial static first pressure P1. For instance, in some implementations, the pressure threshold PT can be set as percentage of the first pressure P1. For example, the pressure threshold PT can be set as about fifty percent (50%) of the static first pressure P1. As another example, the pressure threshold PT can be set as about forty percent (40%) of the static first pressure P1.

As shown in FIG. 3B, if the second pressure P2 is not less than or equal to the pressure threshold PT, the method (300) reverts to (312) where the controller 160 determines whether the predetermined circulation time $T_{CIR}$ has elapsed as described above. Then, if the predetermined circulation time $T_{OR}$ has indeed elapsed, the method (300) proceeds to (328) where the method (300) includes ending or terminating the circulation cycle. In some implementations, terminating the circulation cycle includes deactivating the circulation pump and activating drain pump 168 to drain tub 104 of wash fluid. If, on the other hand, the second pressure P2 is less than or equal to the pressure threshold PT as determined at (316), the method (300) proceeds to (318).

At (318), the method (300) includes deactivating the circulation pump if the second pressure is below the pressure threshold. For instance, if the second pressure P2 is below the pressure threshold PT as determined at (316), then the controller 160 deactivates circulation pump 153. Upon deactivation of circulation pump 153, circulation pump 153 ceases circulating wash fluid throughout tub 104 and the wash fluid returns to sump 138. Typically, a majority of the wash fluid returns to sump 138, however, some of the wash fluid may become trapped or contained in certain articles (e.g., pots, pans, glasses, etc.) within the wash chamber 106 during the circulation cycle. In addition, at (318), the method (300) includes pausing the timer.

As shown in FIG. 4, by way of example, controller 160 monitors the sump pressure, or second pressure P2, during the circulation cycle. If controller 160 determines that the second pressure P2 is less than or equal to the pressure threshold PT, controller 160 deactivates the circulation pump 153. This causes the wash fluid to return to sump 138 (or a majority thereof), and accordingly, the sump pressure rises.

At (320), the method (300) includes determining whether a predetermined time has elapsed after deactivation of the circulation pump. After deactivation of circulation pump 153 at (318), the controller 160 allows time for the wash fluid to return to sump 138 prior to taking any further pressure readings. As one example, the predetermined time can be about three seconds (3 s). As another example, the predetermined time can be about four seconds (4 s). As yet another example, the predetermined time can be between one and a half seconds to five seconds (1.5 s-5 s). If the predetermined time has not elapsed after deactivation of circulation pump 153, then the method (300) loops back to (320) as shown in FIG. 3B. If the predetermined time has indeed elapsed after deactivation of circulation pump 153, then the method (300) proceeds forward to (322).

At (322), the method (300) includes receiving, after the predetermined has elapsed after deactivation of the circulation pump, data indicative of a third pressure of the wash fluid disposed within the tub. For instance, after waiting for the predetermined time to elapse after deactivating the circulation pump 153 as determined at (320), the controller 160 can receive, from pressure sensor 200, data indicative of a third pressure P3 of the wash fluid disposed within the tub 104, or more particularly, sump 138 of tub 104. In this manner, the third pressure P3 is indicative of the static pressure of the wash fluid in sump 138 of tub 104 after performing at least a portion of a circulation cycle. Furthermore, notably, the data indicative of the first pressure P1 of the wash fluid disposed within tub 104 received at (304), the data indicative of the second pressure P2 of the wash fluid disposed within tub 104 received at (314), and the data indicative of the third pressure P3 of the wash fluid disposed within tub 104 received at (322) are all received from pressure sensor 200 positioned on or mounted to sump 138 of tub 104.

At (324), the method (300) includes determining whether the third pressure is within a predetermined range of the first pressure. Stated differently, controller 160 determines whether the static pressure of the wash fluid in tub 104 after performing the circulation time for some time (i.e., the third pressure P3) is within a predetermined range of the static pressure of the wash fluid in tub 104 after the fill cycle and before the circulation cycle (i.e., the first pressure P1). If the third pressure P3 is within the predetermined range of the first pressure P1, such a result indicates that the predetermined volume of wash fluid filled into tub 104 at (302) is still present in tub 104, and accordingly, no leak condition is present. On the other hand, if the third pressure P3 is not within the predetermined range of the first pressure P1, such a result indicates that some or all of the predetermined volume of wash fluid filled into tub 104 at (302) has leaked from dishwasher 100 or has been trapped within articles within wash chamber 106. As one example, the predetermined range can be plus or minus five percent (5%) of the first pressure P1. As another example, the predetermined range can be plus or minus ten percent (10%) of the first pressure P1.

As illustrated in FIG. 4, by way of example, after waiting a predetermined time after deactivation of circulation pump 153, the controller 160 receives another pressure reading, or third pressure P3. The controller 160 then determines whether the third pressure P3 is within the predetermined range of the first pressure P1. As shown in FIG. 4, the third pressure P3 is not within the predetermined range PR of the first pressure P1. Accordingly, controller 160 can generate a control action to attempt to fix or recover the cycle or to abort the cycle as will be explained below. Particularly, after determining whether the third pressure P3 is within the predetermined range of the first pressure P1 at (320), the method (300) includes generating, in response to whether the third pressure is within the predetermined range of the first pressure, a control action.

At (326), if the third pressure P3 is within the predetermined range of the first pressure P1 as determined at (324), generating, in response to whether the third pressure is within the predetermined range of the first pressure, the control action includes reactivating the circulation pump to circulate the wash fluid. As noted above, if the third pressure P3 is within the predetermined range of the first pressure P1 as determined at (324), such a result indicates that the predetermined volume of wash fluid filled into tub 104 at (302) is still present in tub 104, and consequently, no leak condition is present. Accordingly, the circulation cycle can recommence. Thus, at (326), the circulation pump 153 is reactivated to continue the circulation cycle. For instance, to recommence or continue the circulation cycle, the controller 160 can reactivate, after determining that the third pressure P3 is within the predetermined range of the first pressure P1 at (324), the circulation pump 153 to circulate the wash fluid once again. Upon reactivation of the circulation pump 153, circulation pump 153 draws in wash fluid disposed within sump 138 and circulates the wash fluid throughout tub 104, e.g., in a manner described above. Once the circulation cycle is restarted, the method (300) proceeds to (312). In addition, at (326), the method (300) includes restarting the timer.

At (330), if the third pressure P3 is not within the predetermined range of the first pressure P1 as determined at (320), generating, in response to whether the third pressure is within the predetermined range of the first pressure, the control action includes setting a flag indicating that the dishwasher appliance requires a check unit action. As noted above, if the third pressure P3 is not within the predetermined range of the first pressure P1 as determined at (324), such a result indicates that some or all of the predetermined volume of wash fluid filled into tub 104 at (302) has leaked from dishwasher 100 or has been trapped within articles within wash chamber 106. To determine the cause for the lack of wash fluid within sump 138, the controller 160 can set a flag indicating that dishwasher appliance 100 requires a check unit action. As one example, the check unit action can require a user to manually push a button on dishwasher appliance 100. In this way, a user is forced to be physically present at dishwasher appliance 100 before starting another operation cycle or recommencing the current operation cycle. Accordingly, a user is urged to check for leak conditions.

At (332), the method (300) includes pausing or terminating the current cycle. At (332), in some implementations, the operation cycle can be paused and can await a check unit action before commencing the cycle, e.g., at (312). In some implementations, at (332), the method (300) includes ending or terminating the cycle. In some implementations, terminating the circulation cycle includes activating drain pump 168 to drain tub 104 of wash fluid. By way of example, as depicted in FIG. 4, drain pump 168 can be activated and the wash fluid can be drained from tub 104, as denoted by the Line L1.

In some implementations, the control logic of controller 160 can be implemented to control multiple hardware configurations of dishwashers. For instance, the control logic of method (300) can be implemented to control dishwashers without leak pan sensor 204, dishwashers with leak pan sensor 204, and dishwashers in which it is not known whether the dishwasher includes leak pan sensor 204. Accordingly, in implementations in which it is known that dishwasher 100 does not include leak pan sensor 204, the control logic can proceed directly to (330) after determining that the first pressure P1 is not less than or equal to the third pressure P3 at (324). In implementations in which it is known that dishwasher 100 does include leak pan sensor 204, the control logic can proceed directly to (336) after determining that the first pressure P1 is not less than or equal to the third pressure P3 at (324). In implementations in which it is not known whether dishwasher 100 includes leak pan sensor 204, the control logic can proceed to (334) after determining that the first pressure P1 is not less than or equal to the third pressure P3 at (324). For the depicted implementation of FIGS. 3A and 3B, it is not known whether dishwasher 100 includes leak pan sensor 204, thus the control logic or method (300) proceeds to (334).

At (334), the method (300) includes determining whether the dishwasher is equipped with a leak pan sensor. For instance, controller 160 can determine whether dishwasher 100 is equipped with leak pan sensor 204. If dishwasher 100 is equipped with leak pan sensor 204, then method (300) proceeds to (336). If, however, dishwasher 100 is not equipped with leak pan sensor 204, then method (300) proceeds to (330) as shown in FIGS. 3A and 3B.

At (336), after determining dishwasher 100 is equipped with leak pan sensor 204 at (334) or proceeding directly to (336) from (324), the method (300) includes determining whether wash fluid is present at the leak pan sensor. For instance, in some implementations, dishwasher appliance 100 includes leak pan 206 positioned below tub 104 (and sump 138) along the vertical direction V and leak pan sensor 204 mounted thereto. In determining whether wash fluid is present at leak pan sensor 204, the method (300) can include receiving, from leak pan sensor 204, data indicative of whether wash fluid has reached a predetermined level in the leak pan 206. Further, the method (300) can include determining whether wash fluid is present at leak pan sensor 204 based at least in part on the received data indicative of whether wash fluid has reached the predetermined level in leak pan 206.

At (338), if wash fluid is present at the leak pan sensor 204 as determined at (336), generating, in response to whether the third pressure is within the predetermined range of the first pressure, the control action includes setting a flag indicating that the dishwasher appliance has a leak condition. That is, if wash fluid is present at leak pan sensor 204, controller 160 can affirmatively determine that wash fluid has leaked from the unit and has filled into leak pan 206 positioned below tub 104, e.g., as shown in FIG. 2. Accordingly, at (338), controller 160 can set a flag indicating that dishwasher appliance 100 has a leak condition. After setting the flag at (338), the method (300) can proceed to (328) to end the cycle.

At (340), if wash fluid is not present at the leak pan sensor 204 as determined at (336), the method (300) includes determining whether an estimated volume of wash fluid in the tub is less than or equal to a predetermined volume limit. Particularly, if wash fluid is not present at leak pan sensor 204, the lack of wash fluid in sump 138 is not due to a leak condition but because of some other reason, e.g., wash fluid trapped in dishes or wash fluid inadvertently draining from tub 104. Accordingly, to facilitate optimal washing of articles within wash chamber 106, controller 160 can attempt to refill tub 104 to recover the cycle. In some implementations, at (340), the method (300) includes estimating a volume of wash fluid in the tub. Further, the method (300) includes determining whether the estimated volume of wash fluid in the tub is less than or equal to a predetermined volume limit. Particularly, as shown in FIG. 3A, controller 160 determines whether the estimated volume of wash fluid in the tub, denoted as $V_{EST}$, is less than or equal to a predetermined volume limit, denoted as $V_{LIMIT}$. During filling at (302), controller 160 can calculate or estimate the volume of wash fluid in tub $V_{EST}$ by tracking the valve open time of water inlet valve 153 and by knowing or calculating the flow rate through water inlet valve 153. In this way, the predetermined volume of wash fluid within tub $V_{EST}$ can be estimated. The predetermined volume limit $V_{LIMIT}$ can be set as a volume that corresponds with the first pressure P1 recorded after filling at (302), for example. In other implementations, the predetermined volume limit $V_{LIMIT}$ can be set as a volume that corresponds with some percentage of the first pressure P1, such as e.g., 95% of the first pressure P1.

If the estimated volume of wash fluid in the tub $V_{EST}$ is not less than or equal to the predetermined volume limit $V_{LIMIT}$ as determined at (340), then the method (300) proceeds to (330) and (332) as depicted in FIG. 3A. If, on the other hand, the estimated volume of wash fluid in the tub $V_{EST}$ is less than or equal to the predetermined volume limit $V_{LIMIT}$ as determined at (340), then the method (300) proceeds to (342) where controller 160 causes dishwasher 100 to perform a refilling operation.

At (342), if the estimated volume of wash fluid in the tub $V_{EST}$ is less than or equal to the predetermined volume limit $V_{LIMIT}$ as determined at (340), generating, in response to whether the third pressure P3 is within the predetermined range of the first pressure P1, the control action includes filling the tub with a second or additional predetermined volume of wash fluid. Particularly, at (342), the method (300) includes filling an additional volume of wash fluid into the tub of the dishwasher appliance. Then, as shown in FIG. 3A, the method (300) can proceed to (326) where method (300) includes reactivating the circulation pump to circulate the wash fluid and the additional volume of wash fluid. Accordingly, with tub 104 refilled with an additional volume of wash fluid, controller 160 can activate circulation pump 153 to continue circulating the original volume of wash fluid filled into tub 104 at (302) and the additional or second volume of wash fluid filled into tub 104 at (342).

By way of example, as depicted in FIG. 4, in some implementations, the tub can be filled with a second or additional predetermined volume of wash fluid, as depicted by the Line L2. After filling the additional volume into the tub, the circulation pump can be reactivated at (326), which is represented by the decrease in sump pressure along Line L2.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method of detecting a leak condition for a dishwasher appliance, the method comprising:

filling a wash fluid into a tub of the dishwasher appliance;

receiving data indicative of a first pressure of the wash fluid disposed within the tub;

activating, after receiving the data indicative of the first pressure of the wash fluid disposed within the tub, a circulation pump to circulate the wash fluid;

iteratively receiving data indicative of a second pressure of the wash fluid disposed within the tub;

determining whether the second pressure is less than a pressure threshold;

deactivating the circulation pump if the second pressure is less than the pressure threshold;

receiving, after a predetermined time of deactivating the circulation pump, data indicative of a third pressure of the wash fluid disposed within the tub;

determining whether the third pressure is within a predetermined range of the first pressure; and generating, in response to whether the third pressure is within the predetermined range of the first pressure, a control action.

2. The method of claim 1, wherein the data indicative of the first pressure of the wash fluid disposed within the tub, the data indicative of the second pressure of the wash fluid disposed within the tub, and the data indicative of a third pressure of the wash fluid disposed within the tub are received from a pressure sensor positioned on or mounted to a sump of the tub.

3. The method of claim 1, wherein if the second pressure is not less than the pressure threshold, the method further comprises:

determining whether a predetermined circulation time has elapsed; and deactivating the circulation pump if the predetermined circulation time has elapsed.

4. The method of claim 1, wherein if the third pressure is within the predetermined range of the first pressure, generating, in response to whether the third pressure is within the predetermined range of the first pressure, the control action comprises:

reactivating the circulation pump to circulate the wash fluid.

5. The method of claim 1, wherein if the third pressure is not within the predetermined range of the first pressure, generating, in response to whether the third pressure is within the predetermined range of the first pressure, the control action comprises:

setting a flag indicating that the dishwasher appliance requires a check unit action.

6. The method of claim 1, wherein the dishwasher appliance has a leak pan positioned below the tub along a vertical direction and a leak pan sensor, and wherein if the third pressure is within the predetermined range of the first pressure, the method further comprises:

receiving, from the leak pan sensor, data indicative of whether wash fluid has reached a predetermined level in the leak pan; and determining whether wash fluid is present at the leak pan sensor based at least in part on the received data indicative of whether wash fluid has reached the predetermined level in the leak pan.

7. The method of claim 6, wherein if wash fluid is present at the leak pan sensor, generating, in response to whether the third pressure is within the predetermined range of the first pressure, the control action comprises:

setting a flag indicating that the dishwasher appliance has the leak condition.

8. The method of claim 6, wherein if wash fluid is not present at the leak pan sensor, the method further comprises:

estimating a volume of wash fluid in the tub; and determining whether the estimated volume of wash fluid in the tub is below or equal to a predetermined volume limit.

9. The method of claim 8, wherein if the estimated volume of wash fluid in the tub is below or equal to the predetermined volume limit, generating, in response to whether the third pressure is within the predetermined range of the first pressure, the control action comprises:

filling an additional volume of wash fluid into the tub of the dishwasher appliance; and reactivating the circulation pump to circulate the wash fluid and the additional volume of wash fluid.

10. The method of claim 8, wherein if the estimated volume of wash fluid in the tub is not below or equal to the predetermined volume limit, generating, in response to whether the third pressure is within the predetermined range of the first pressure, the control action comprises:

setting a flag indicating that the dishwasher appliance requires a check unit action.

11. The method of claim 1, wherein the data indicative of the first pressure of the wash fluid disposed within the tub is sensed by a pressure sensor after a predetermined volume of the wash fluid is filled into the tub of the dishwasher appliance.

12. The method of claim 11, wherein after receiving the data indicative of the first pressure of the wash fluid disposed within the tub, the method further comprises:

determining whether the first pressure of the predetermined volume of the wash fluid is maintained within a predetermined range for a predetermined time, and wherein if the first pressure of the predetermined volume of the wash fluid is maintained within the predetermined range for the predetermined time, the circulation pump is activated to circulate the wash fluid, and wherein if the first pressure of the predetermined volume of the wash fluid is not maintained within the predetermined range for the predetermined time, the circulation pump is not activated.

* * * * *